US010113285B2

(12) United States Patent
Nadeau

(10) Patent No.: US 10,113,285 B2
(45) Date of Patent: Oct. 30, 2018

(54) REVETMENT SYSTEM

(71) Applicant: Shoretec, LLC, Baton Rouge, LA (US)

(72) Inventor: James A. Nadeau, Bangor, ME (US)

(73) Assignee: Shoretec, LLC, Baton Rouge, LA (US)

( * ) Notice: Subject to any disclaimer, the term of this patent is extended or adjusted under 35 U.S.C. 154(b) by 0 days.

(21) Appl. No.: 15/267,522

(22) Filed: Sep. 16, 2016

(65) Prior Publication Data

US 2017/0081819 A1 Mar. 23, 2017

Related U.S. Application Data

(60) Provisional application No. 62/221,830, filed on Sep. 22, 2015.

(51) Int. Cl.
*E02B 3/12* (2006.01)
*E02B 3/14* (2006.01)

(52) U.S. Cl.
CPC ..... *E02B 3/12* (2013.01); *E02B 3/123* (2013.01); *E02B 3/126* (2013.01); *E02B 3/14* (2013.01)

(58) Field of Classification Search
None
See application file for complete search history.

(56) References Cited

U.S. PATENT DOCUMENTS 4,572,705 A * 2/1986 Vignon ..... E01C 3/006 405/16
5,823,709 A * 10/1998 Maher ..... E02B 3/122 405/16
5,882,453 A * 3/1999 Stark ..... B09B 1/00 156/292
7,431,536 B2 * 10/2008 Benda ..... E02D 27/02 405/229
2009/0169311 A1 * 7/2009 Sharley ..... E01B 1/001 405/302.6

* cited by examiner

*Primary Examiner* — Kyle Armstrong
(74) *Attorney, Agent, or Firm* — John H. Thomas, P.C.

(57) ABSTRACT

A revetment system includes multiple layers to reinforce a surface exposed to possible high water flow. The revetment system includes both a cellular confinement layer and an articulated block layer. The cellular confinement layer is adapted to be placed on the ground surface to be protected. The block layer is mounted on top of that cellular confinement layer. Optional geosynthetic layers may be mounted under the cellular confinement layer and between the cellular confinement layer and block layers.

11 Claims, 3 Drawing Sheets

REVETMENT SYSTEM

This application claims the benefit of filing of U.S. Provisional Patent Application No. 62/221,830, filed on Sep. 22, 2015, incorporated by reference herein in its entirety.

The present invention is directed a revetment system for water flow locations where the flowing water can cause surface erosion. Specifically, the system includes both a cellular confinement layer and an articulated block layer mounted on top of a surface that is exposed to possible water-caused erosion.

BACKGROUND

Effective revetment systems can be essential to retain surface soil and material in place in water flow areas. For instance, a dry stream bed may experience occasional wash outs during heavy storm events. Shorelines along a lake or beach may be subject to corrosive wave and/or tidal action. Additionally, sloped surfaces such as an earthen dam face or hills and slopes next to roads or building sites can benefit from effective revetment systems.

Conventional, single-layer revetments, optionally mounted on a geotextile fabric, may be appropriate for many applications. These sorts of single-layer systems include covering a subgrade with a geotextile fabric in combination with articulated concrete blocks or a cellular confinement system. However, some of these revetment systems may be subject to high water velocities, wave attack and potentially a hydraulic jump during a high-flow event such as a substantial rain storm, flooding or high tides. In these events, water can wash out the subgrade dirt and material underneath a revetment system. This can cause a slope to collapse and banks and surfaces to erode. In extreme situations, this can lead to dam breaches.

SUMMARY

Accordingly, it is an object of the present invention to overcome or reduce the possibility of failure that is experienced in existing revetment systems. In the present system, both a cellular confinement matrix layer and an articulated concrete block layer are used on top of each other to better prevent damage to a slope of dirt and/or other ground surface material.

In one example, a multi-layer revetment system includes a cellular confinement layer and an articulated block layer. The cellular confinement layer is adapted to be placed on a ground surface, the cellular confinement system is a matrix of rigid wall cells that are open across the height of the cells. The articulated block layer is adapted to be mounted on top of the cellular confinement layer and on the opposite side of the cellular confinement layer from the ground surface. The multi-layer revetment system may further include a geosynthetic layer that is positioned on the ground surface and under the cellular confinement layer. The geosynthetic layer may be a permeable layer or an impermeable layer. Alternatively, there may be a second geosynthetic layer positioned between the cellular confinement layer and the articulated block layer. This second geosynthetic layer may be a permeable or impermeable layer. The open cells of the cellular confinement layer may be filled with aggregate or with sand. The articulated block layer may be formed of a plurality of blocks that are premounted on an underlying mat layer. The blocks in the articulated block layer may be uniform in shape, and further, they may be formed from concrete. The blocks of the articulated block layer may be connected to one or more of the next adjacent blocks.

DETAILED DESCRIPTION

The invention described herein is a multi-layer revetment system engineered to protect relatively high water flow surfaces from erosion and degradation. The system includes at least two layers—a cellular confinement layer and an articulated block layer. Each of these layers is separately known and deployed in various environmental applications. Here, they are deployed together to provide enhanced protection of a ground surface. An understanding of the prior art assists in the understanding of the system disclosed herein.

Figure 1:
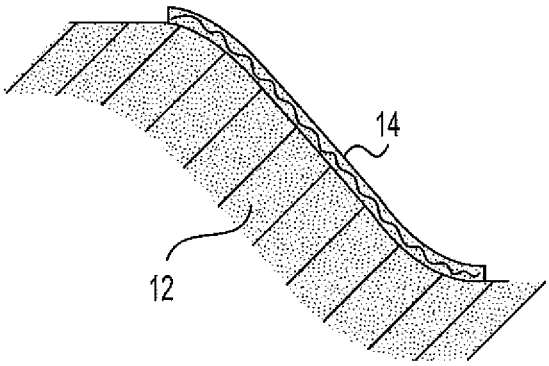
FIG. 1 (Prior Art)
FIG. 1 is side view of a sloped grade having a geotextile layer mounted thereon.
Figure 2:
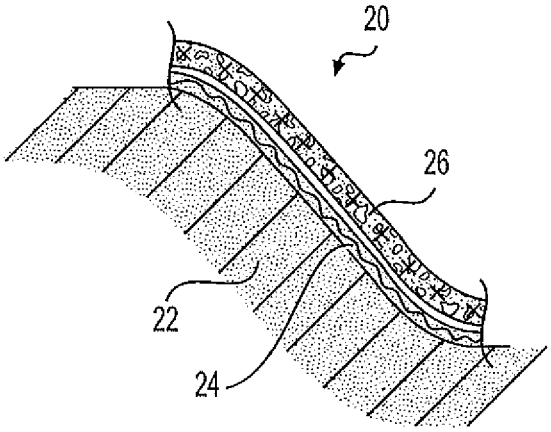
FIG. 2 (Prior Art)
FIG. 2 is a side view of a sloped grade having a geotextile layer and cellular confinement layer mounted thereon.
Figure 3:
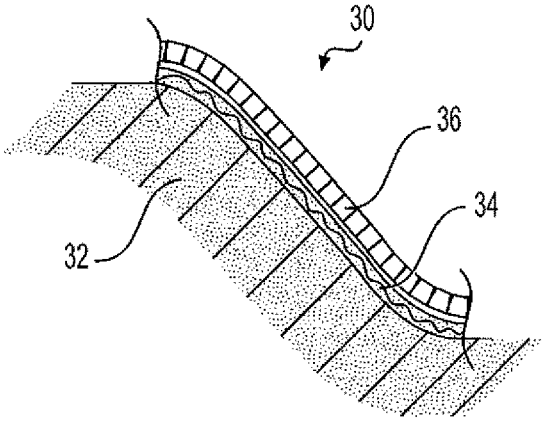
FIG. 3 (Prior Art)
FIG. 3 is a side view of a sloped grade having a geotextile and an articulated concrete block layer mounted thereon.

Turning first to FIGS. 1-3, there are shown three examples of existing, prior art revetment systems. These examples all illustrate revetment systems placed on a sloped surface such as the side of a dam or hillside. In FIG. 1, a sloped subgrade 12 has a geotextile fabric 14 mounted thereon. This particular type of revetment would typically be used in connection with low water flow situations. The geotextile fabric 14 helps prevent the wash out that may occur with respect to the subgrade 12. The geotextile fabric 14 is typically porous and allows vegetation to grow through it to additionally help shore up the slope surface.

FIG. 2 illustrates a second revetment system 20. The sloped subgrade 22 has a geotextile fabric 24 mounted thereon. Further, mounted over the geotextile fabric 24 is a cellular confinement system 26. This cellular containment system 26 has a rigid cellular structure with the open cells in that system filled with soil, sand or aggregate gravel or mixtures thereof. Over time, the cellular system can be subject to water flow that washes away or at least reduces the amount of filler that is placed in the open cells of the cellular system matrix. The cellular confinement system then becomes less substantial and less able to retain the underlying geotextile fabric and ground surface beneath it.

FIG. 3 is a further alternative revetment system 30 where the sloped subgrade 32 has a geotextile fabric 34 mounted thereon. Mounted over the geotextile fabric 34 is an articulated concrete block layer 36. The articulated concrete block layer 36 helps to secure the geotextile fabric layer 34 on the subgrade surface to prevent unwanted wash out in the subgrade 32.

Figure 4:
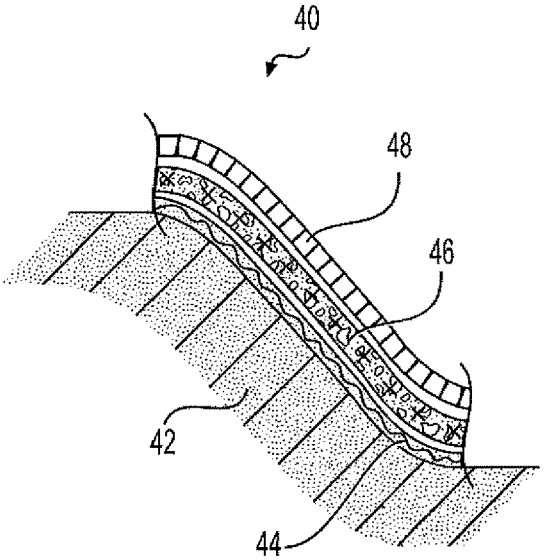
FIG. 4 is a side view of a sloped grade having a geosynthetic layer secured by both a filled cellular confinement matrix system and an articulated concrete block layer.

The present invention is illustrated in, but is not limited to, one example, in FIG. 4. In this example, the revetment system 40 is mounted onto the sloped subgrade 42. The surface of the subgrade 42 is covered with a geosynthetic layer 44. Mounted over the geosynthetic layer 44 is a cellular confinement system 46. Then, over the cellular confinement system 46 there is mounted an articulated concrete block layer 48.

Figure 5:
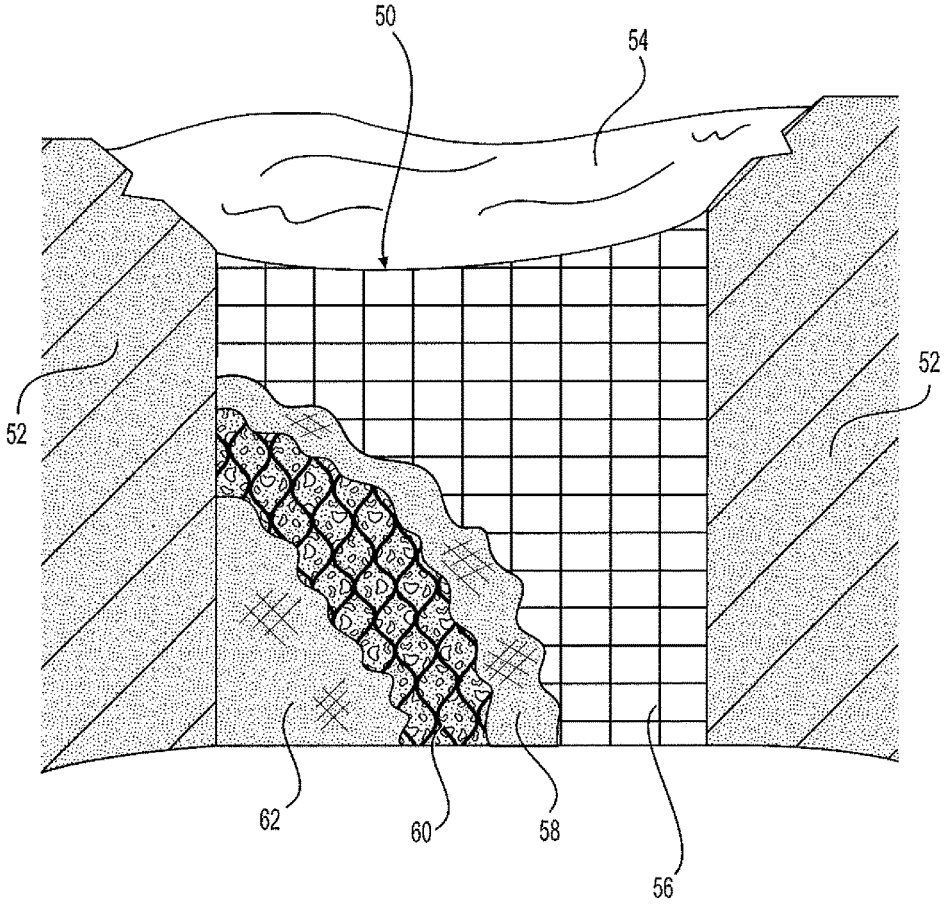
FIG. 5 is a perspective view of a revetment system on a sloped surface with partial cut-away views of the revetment system to show the layers that form it.

Likewise, FIG. 5 illustrates another example of a revetment system 50. In this front perspective view with partial cut-away views seen that show the various layers of the revetment system 50. The revetment system 50 is installed on a dam hillside 52. The pond 54 is maintained by the hillside 52. The revetment system 50 is installed to prevent or at least reduce possible erosion that could occur in the event of a dam overflow in an unexpected or unlikely circumstance. Without the revetment system 50, the hillside 52 could erode and, in a worst case, cause the hillside to breach and cause a dam break.

The top layer of the revetment system is a layer of articulated blocks 56. These blocks are shown in a relatively rectangular pattern. Underneath the block layer 56 is a second geosynthetic layer 58. This second geosynthetic layer 58 can aid in the frictional engagement with layers below. It may also protect the hypothetical washout of material from the cellular confinement layer 60 that is below. This cellular confinement layer 60 is underneath the second geosynthetic layer 58. The cells of the cellular confinement layer 60 are filled with aggregate. The bottom of the revetment system 50 is a first geosynthetic layer 62 that is positioned onto the top surface of the hillside 52.

Before deploying any revetment system, the first installation step includes the appropriate smoothing and compaction of the subgrade material. The subgrade material may include soil, sand, aggregate and mixtures thereof. There may be additional larger stones and materials that may be included therein. This surface is preferably treated so that it is generally smooth, even and compact. The subgrade material should preferably be appropriate in porosity and density for the particular location and expected water flow possibilities.

The geosynthetic layer that is deployed an optional layer. It is not mandatory, however, it is reasonably recommended in water flow locations. The geosynthetic layer may be a porous geotextile fabric, or it may be an impermeable liner web. An impermeable liner may include a polymer sheet. The polymer sheet may be about 50 mils thick, or alternatively about 20 to 100 mils in thickness. Alternatively, the geosynthetic layer may be a geotextile fabric that is a woven or non-woven, water-permeable layer. This geotextile fabric sheet may also be formed of polymer, paper, wire-reinforced and/or mess reinforced fabric. This woven or non-woven fabric can be formed from different materials and have different densities and resulting porosity.

The geosynthetic layer can be a liner that may be double-layered with the same or different film or fabric liner material. In one example, the liner has spikes on one side that is intended to lay flat on and grip the subgrade. Similarly, the top side of the liner intended to abut the bottom of the cellular confinement layer preferably has a dimpled or textured surface in order to improve the frictional grip of the liner to the bottom of the cellular confinement system layer. Regulatory guidance with respect to geosynthetic materials is found in National Concrete Masonry Association (NCMA) and the Hydraulic Engineering Circular (HEC) from the Army Corp of Engineers. Additional guidance can be found in other regulatory and local documents and guidelines.

A geosynthetic layer may be disposed both on the ground surface and also between the cellular confinement and articulated block layers. The material that forms the geosynthetic layer may be the same in these different application locations. Alternatively, these different geosynthetic layers may be different. The second geosynthetic layer between the cellular confinement and block layers can be an impermeable film or a permeable geotextile fabric.

The next layer of the revetment system described herein is the cellular confinement layer. This type of layer is, in one non-limiting example, a Presto Geoweb system in reference to a commercial system that is widely used. Other geocell or cellular confinement systems generally may be used as well. A cellular confinement system is a matrix of rigid walls, typically made of rigid plastic or concrete, that define open cells therein that extend through the height of the matrix. These open cells can be round or square or hexagonal of other shape in cross-section. Water will flow through these open cells and be absorbed by the underlying ground material.

The cellular system may have different sizes, different cellular shapes and different height ratios that stabilize soil/sand/stone material that is filled into the open cells. These products may be thinner and more rigid in profile, relatively speaking. Alternatively, they can be thicker and more heavy as well. This layer has a height of approximately 2 inches to 6 inches depending on the particular revetment engineering requirements. Alternatively, this cellular confinement cell height or drainage layer may have a height of from about 1 to 12 inches. These cells are often filled with aggregate of multiple sizes or mixtures, or alternatively sand, topsoil, or any other material, both naturally occurring or manufactured, that will reduce the potential for erosion. A typical type of aggregate is a $D_{50}$ (¾ inch) aggregate. Alternative aggregates could be $D_{50}$ stone of ⅜ inch to 1.5 inches.

The top layer of the revetment system is commonly referred to as an articulated concrete block layer. These articulated concrete blocks may be arranged in a flat layer (untapered) or a tapered layer depending on the system requirements. The respective concrete blocks can be unconnected to each other or they may be connected together. The blocks can be cabled to one or more of the adjacent blocks in the layer. They can be wet cast or dry cast. Still further, the blocks may be adhered to and pre-mounted onto a mat layer, or the blocks may be hand placed by an installer at a revetment site.

The shape of the concrete blocks is not limited. They may be different sizes and geometric shapes. Some sample types of articulated concrete blocks systems may include blocks having the shapes of rectangles, triangles, hexagons, or circular. The height of these blocks may be 2 to 12 inches. The size of these blocks may be from 0.5 $ft^2$ to 4 $ft^2$ in area with unit weights ranging from 20 to 120 pounds per square foot. The block layer may also include wedge shaped block that is, for example, available commercially in one brand known as ArmorWedge. Finally, when referring to concrete blocks, the actual concrete material itself of these blocks may be traditionally cement-based. Other materials could be used including recycled plastics, glass, soil cement and/or fly ash. Alternative cement mixes may also be used as the binder for the concrete blocks. Also, while referred to as concrete blocks, the blocks may alternatively be bricks or other pavers and paver products.

Other embodiments of the present invention will be apparent to those skilled in the art from consideration of the specification. It is intended that the specification and figures be considered as exemplary only, with a true scope and spirit of the invention being indicated by the following claims.

That which is claimed is:

1. A multi-layer revelment system adapted to be placed on top of a ground surface to inhibit its erosion, comprising:

a cellular confinement layer comprising a matrix of rigid wall cells that are open across the height of the cells, wherein the height of the cells is about 1 to 12 inches, an articulated block layer adapted to be placed on top of the cellular confinement layer on the opposite side of the cellular confinement layer than the ground surface, and a permeable geosynthetic layer that is adapted to be placed on the ground surface and under the cellular confinement layer;

and wherein none of the layers are fixed to an adjacent layer.

2. The multi-layer revetment system described in claim 1, further comprising a second geosynthetic layer positioned between the cellular confinement layer and the articulated block layer.

3. The multi-layer revetment system described in claim 2, wherein the second geosynthetic layer is a permeable layer.

4. The multi-layer revetment system described in claim 1, wherein the open cells in the cellular confinement layer are filled with sand.

5. The multi-layer revetment system described in claim 1, wherein the open cells in the cellular confinement layer are filled with aggregate.

6. The multi-layer revetment system described in claim 1, wherein the articulated block layer is comprised of a plurality of blocks pre-mounted on an underlying mat layer.

7. The multi-layer revetment system described in claim 1, wherein all of the blocks in the articulated block layer are substantially uniform in shape.

8. The multi-layer revetment system described in claim 1, wherein the blocks in the articulated block layer are concrete.

9. The multi-layer revetment system described in claim 1, wherein each of the blocks in the articulated block layer are connected to one or more of the next adjacent blocks.

10. The multi-layer revetment system described in claim 1, wherein the height of each of the blocks in the articulated block layer is about 2-12 inches.

11. The multi-layer revetment system described in claim 1, wherein each of the blocks of the articulated block layer has a top surface area of about 0.5 to 4 square feet.

* * * * *